United States Patent [19]

Kulesza et al.

[11] 4,309,840

[45] Jan. 12, 1982

[54] INFLATABLE TOP

[75] Inventors: Ralph J. Kulesza, Chicago; Harry Disko, South Barrington, both of Ill.

[73] Assignee: Marvin Glass & Associates, Chicago, Ill.

[21] Appl. No.: 175,691

[22] Filed: Aug. 13, 1980

[51] Int. Cl.[3] ..... A63H 1/06; A63H 1/02; A63H 3/06

[52] U.S. Cl. ..... 46/68; 46/67; 46/87

[58] Field of Search ..... 46/68, 88, 69, 87, 67

[56] References Cited

U.S. PATENT DOCUMENTS

| | | | |
|---|---|---|---|
| 3,449,858 | 6/1969 | Balleis | 46/68 |
| 3,785,081 | 1/1974 | Burkhart | 46/68 |
| 3,879,887 | 4/1975 | Brookson, Jr. et al. | 46/69 |
| 4,038,777 | 8/1977 | Schwartz | 46/87 |

*Primary Examiner*—Gene Mancene

*Assistant Examiner*—Michael J. Foycik

*Attorney, Agent, or Firm*—Mason, Kolehmainen, Rathburn & Wyss

[57] ABSTRACT

An inflatable top is described having an attached manual rotation mechanism. The rotating body portion of the top includes an inflatable, plastic enclosure which expands to a desired shape when inflated with a gas. The rotation mechanism converts a linear force applied to the top, parallel to its vertical axis, into a rotation around its axis of the top and the rotation mechanism. The mechanism includes a helical member mounted for reciprocal movement into and out of a housing secured within the top. The helical member threads through a clutch element rotated by the linear motion of the helical member. The clutch element causes the top to rotate when the force applied to the helical member is in one direction and is disengaged and does not cause the top to rotate when the force applied to the helical member is in a different direction.

3 Claims, 5 Drawing Figures

INFLATABLE TOP

BACKGROUND OF THE INVENTION

1. Field of the Invention

This invention relates generally to amusement devices and particularly to inflatable toy tops.

2. Brief Description of the Prior Art

Hollow tops made out of flexible material are well known in the art. For example, U.S. Pat. No. 1,193,991 issued to Cigol on Aug. 8, 1916 discloses a hollow spherical top made out of rubber which is usable both as a top and as a ball. U.S. Pat. No. 2,449,405 issued to Mordan on Sept. 14, 1948 discloses a top in the form of an inflatable bag or balloon which is propelled by the exhaust of air from the top itself. Another inflatable top is disclosed in U.S. Pat. No. 3,879,887 issued to Brookson on Apr. 29, 1975. In Brookson a pull string drive member is separable from the top itself by means of a serrated tooth connection.

SUMMARY OF THE INVENTION

It is an object of the present invention to provide an inflatable top with an attached rotation mechanism.

It is still another object of the present invention to provide an inflatable top capable of easy initial rotation.

It is another object of the present invention to provide a top which is easily rotated with one hand.

These and other objects of the present invention are achieved by an inflatable top that includes an inflatable, rotating enclosure and a rotation mechanism. The rotation mechanism, secured to the enclosure, converts a linear motion into rotary motion. The rotation mechanism includes a helical member drivingly connected to the enclosure. The inflatable enclosure includes a supporting means for supporting the top for rotation on a surface.

DESCRIPTION OF THE PREFERRED EMBODIMENT

Figure 1:
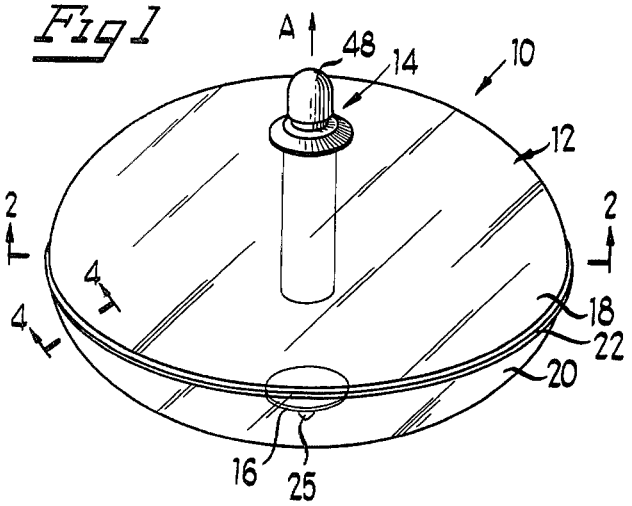
FIG. 1 is a perspective view of one embodiment of the present invention.

Referring to the drawing wherein like reference characters are used for like parts throughout the several views, an inflatable top 10 conveniently made of flexible plastic sheet material is shown in FIG. 1. The top 10 includes an inflatable enclosure 12 which is shown as a flattened sphere or ellipsoid, a rotation mechanism 14 and a support 16.

The enclosure 12 includes two halves 18 and 20 connected along a peripheral seam 22. If the enclosure 12 is made of flexible plastic sheet material the seam 22 may be made by heat sealing or other conventional means. The enclosure 12 includes an inflation valve 24. The support 16 is preferably made of relatively rigid material secured by adhesive or the like to the enclosure 12 along its axis, and includes a pointed tip 25 shown in FIG. 2.

Figure 2:
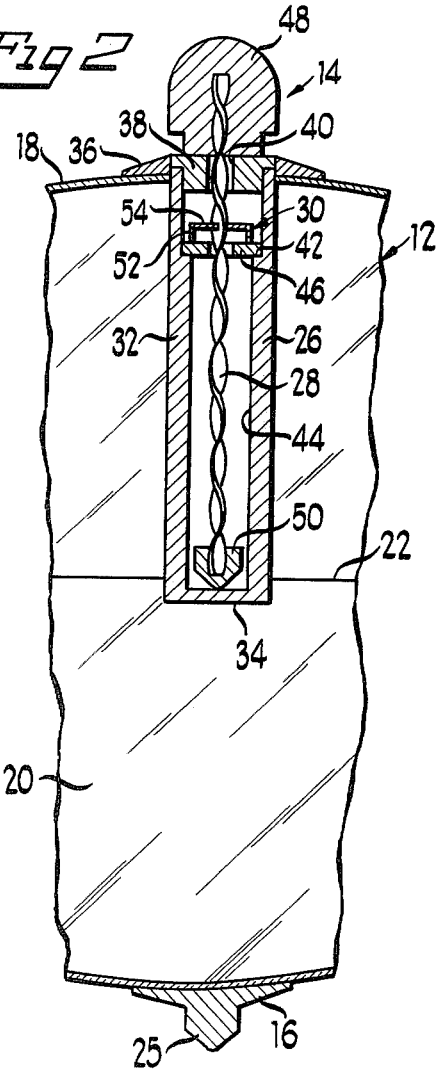
FIG. 2 is a partial, enlarged, cross-sectional view taken generally along the line 2—2 in FIG. 1.
Figure 3:
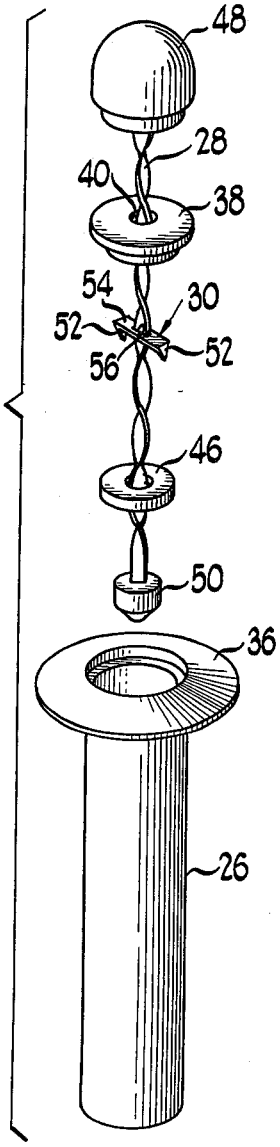
FIG. 3 is an exploded view of the rotation mechanism shown in FIG. 2.

A rotation mechanism 14, shown in FIGS. 2 and 3, includes a housing 26 extending into the interior of the inflatable enclosure 12, a helical member 28 and a clutch element 30. The housing 26 includes a generally tubular outer wall 32 having a closed end 34, an outwardly extending toroidal flange 36 secured by adhesive or the like to the outside of the enclosure 12, and a top end 38 having an opening 40 located at its center. The flange 36 is secured around end 38 which, in turn, is retained in housing 26. A toroidal disc 46 is secured on land 42 formed on the interior surface 44 of housing 26 near top end 38.

The helical member 28, conveniently a twisted strip of metal, includes a handle portion 48 on one end and a widened stop element 50 on the other end. The helical member 28 extends through the opening 40 in top end 38, through the opening in the center of disc 46 and is retained against removal by the stop element 50 and handle portion 48.

The clutch element 30 includes two downwardly extending dog-earred portions 52 on either end of a base plate 54. A slot 56, positioned at the center of the base plate 54, conforms to the exterior surface of the helical member 28.

Figure 4:
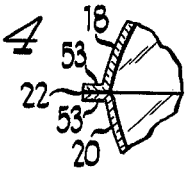
FIG. 4 is a partial, enlarged, cross-sectional view taken generally along the line 4—4 of FIG. 1.
Figure 5:
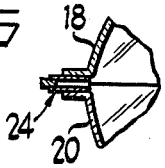
FIG. 5 is a view similar to that shown in FIG. 4 of another embodiment of the present invention.

The peripheral seam 22, shown in FIG. 4, may include an outwardly turned edge portion 53 of each half 18 or 20 joined face to face. The portions 53 may be joined by heat sealing, adhesive or any other conventional means. As shown in FIG. 5, the inflation means in the form of the valve 24 may be in the seam 22 between the enclosure halves 18 and 20. Each enclosure half 18 or 20 is then securely connected adjacent the valve 24 to maintain the integrity of the enclosure 12. A weighted disc may be secured between the seam in order to impart weight to the top 10 and adhesive or other suitable securement means may be used to secure the disc within the seam 22.

The device operates as follows. The top 10 is inflated through inflation valve 24 to its full distended configuration shown in FIG. 1, and support 16 of top 10 is then placed on a supporting surface. The user then grasps the handle portion 48 and extends it outwardly in the direction indicated by the arrow A (FIG. 1) while retaining the enclosure 12 with the other hand. This causes the helical member 28 to extend through the toroidal disc 46 and the top end 38 of housing 26 until stop element 50 comes to rest against toroidal disc 46. At the same time the clutch element 30 moves upwardly towards top end 38, disengaging dog-earred portions 52 from toroidal disc 46. Therefore no rotation is imparted to the top 10 as the helical member 28 is displaced upwardly.

With the helical member 28 fully extended, the user then presses the member 28 inwardly into the top 10, with one hand, in a direction opposite that indicated by the arrow A. This causes the helical member 28 to thread through the clutch element 30. Because of the helical curvature of the surface of the helical member 28 a downward force is imparted to the clutch element 30. This causes the dog-earred portions 52 to be pressed against and frictionally engage the toroidal disc 46. At the same time the helical shape of the helical member 28 causes the clutch element 30 to rotate as the helical member 28 passes through the slot 56. The rotation of the helical member 28 is then transferred to the toroidal disc 46 which transfers this motion to the enclosure 12 through outwardly extending flange 36 secured to the surface of the enclosure 12. When the helical member 28 is returned to its inward position shown in FIG. 1, it is quickly released and the top is allowed to continue to spin by its own momentum on support 16. The inclusion of a disc in the seam 22 will allow the top to store additional rotational energy and enables the top to spin for a longer period of time.

The foregoing detailed description has been given for clearness of understanding only and no unnecessary limitations should be understood therefrom as many modifications will be obvious to those skilled in the art.

What is claimed is:

1. An inflatable top comprising:

a generally symmetrical, flexible, inflatable enclosure having an axis and including a supporting means along said axis for supporting said top for rotation on a surface; and a generally rigid rotation mechanism secured to said enclosure for converting linear motion along the axis of said enclosure to rotary motion around said axis, said mechanism including a helical member drivingly connected to said enclosure through a one-way clutch and mounted for reciprocal motion into and out of said enclosure along the axis of said enclosure, a housing extending inwardly of said enclosure for receiving said helical member, said housing having means engageable by said clutch for imparting rotary motion to said enclosure, and a stop member on said helical member to prevent removal of said helical member from said housing, said housing extending from the surface of said enclosure into the interior of said enclosure, and having a free end spaced from said surface of said enclosure such that said enclosure provides a spring mounting for said mechanism when said enclosure is inflated.

2. The top of claim 1 wherein said enclosure has a flattened spherical shape.

3. The top of claim 1 wherein said enclosure includes two halves joined along a seam.

* * * * *